US008049601B1

(12) United States Patent
Hofer et al.

(10) Patent No.: US 8,049,601 B1
(45) Date of Patent: Nov. 1, 2011

(54) GENERATING SERVO CONTROL PULSES AT A RECEIVER

(75) Inventors: Richard A. Hofer, Gardner, KS (US); Jonathan R. Feldkamp, Gardner, KS (US)

(73) Assignee: Castle Creations, Inc., Olathe, KS (US)

( * ) Notice: Subject to any disclaimer, the term of this patent is extended or adjusted under 35 U.S.C. 154(b) by 1222 days.

(21) Appl. No.: 11/741,357

(22) Filed: Apr. 27, 2007

(51) Int. Cl.
*G08C 19/12* (2006.01)

(52) U.S. Cl. ..... 340/13.34; 340/1.1; 340/13.2; 340/13.33; 701/2; 701/33; 701/36; 701/102; 701/110; 446/6; 446/31; 446/454; 901/6; 901/8; 901/32; 901/36

(58) Field of Classification Search ..... 340/1.1, 340/2.31, 2.4, 2.24–2.28, 3.5, 3.55, 13.2, 340/13.33, 13.34; 701/33, 36, 102, 110; 446/6, 31, 454; 901/6, 8, 20, 23, 24, 32, 901/36

See application file for complete search history.

(56) References Cited

U.S. PATENT DOCUMENTS

| | | | | |
|---|---|---|---|---|
| 4,206,411 | A * | 6/1980 | Meyer | 340/12.16 |
| 2003/0043053 | A1 * | 3/2003 | Schuckel | 340/825.69 |
| 2004/0085222 | A1 * | 5/2004 | Yoshikawa | 340/825.69 |

* cited by examiner

*Primary Examiner* — George Bugg
*Assistant Examiner* — Sisay Yacob
(74) *Attorney, Agent, or Firm* — Shook, Hardy & Bacon, LLP

(57) ABSTRACT

Systems and methods are provided for controlling one or more servos coupled to a model vehicle. An input signal having a series of input pulses encoded at an input pulse repetition frequency is received at a receiver coupled to a model vehicle having one or more servos. The input signal is decoded at the receiver. A servo control pulse is generated using at least one of the input pulses at the receiver. The servo control pulse is outputted to at least one of the servos at an output pulse repetition frequency that is different from the input pulse repetition frequency.

20 Claims, 5 Drawing Sheets

GENERATING SERVO CONTROL PULSES AT A RECEIVER

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND

In general, receivers mounted on model vehicles in the hobby market are simple analog devices. Typically, the receivers receive a series of modulated analog input pulses from a transmitter. This transmission may be made in a number of formats. One format known in the art is to encode the analog input pulses as a series of modulated pulses bearing an analog pulse width on a number of adjacent channels. Another format known in the art is to encode the analog input pulses as a Pulse Code Modulated encoding of the information at a frame frequency. Another format known in the art is to encode the analog input pulses as a spread spectrum signal encoding the information at a frame frequency. Average frame frequency represents an average number of frames that are repeated in one second. Once the encoded input pulses are received at a receiver they are split into servo control pulses, and the servo control pulses are output to servos that are coupled to a model vehicle. Consequently, the average frame frequency of the input pulses is mirrored in the repetition frequency of the output servo control pulses. More sophisticated receivers may include additional capacity to filter the input pulses using a microprocessor and/or to provide a fail-safe feature (e.g., outputting predetermined servo control pulses in the event the input pulses are unrecognizable). However, the average frame frequency of the input pulses is still mirrored in the repetition frequency of the output servo control pulses.

Typically, the average frame frequency is 50 Hz, however some low-channel-count transmitters may transmit the input pulses at a higher repetition frequency, but the higher average frame frequency is still mirrored in the pulse repetition frequency of the output servo control pulses.

SUMMARY

The present invention is defined by the claims below, not this summary. Embodiments of the present invention provide a system, method, and product for, among other things, generating servo control pulses at a programmable output pulse repetition frequency that is different from an average input frame frequency. The present invention provides several practical advantages, including improved servo response time to the servo control pulses and increased output torque that result when the output pulse repetition frequency is increased.

In a first aspect, an exemplary embodiment of the present invention relates to a method for controlling one or more servos coupled to a model vehicle. A receiver coupled to a model vehicle having one or more servos receives an input signal having a series of input pulses encoded at a first average frame frequency. The receiver decodes the input signal. The receiver generates a servo control pulse using at least one of the input pulses. The servo control pulse is outputted to at least one of the servos at a second pulse repetition frequency.

In another aspect, an exemplary embodiment of the present invention relates to a receiver for generating servo control pulses for a model vehicle having one or more servos at a programmable output pulse repetition frequency that is different from an average input frame frequency. The receiver includes a communication module and a processing module. The communication module is configured to receive an input signal having a series of input pulses encoded at an average input frame frequency. The processing module is configured to output a servo control pulse generated using at least one of the input pulses to at least one of the servos at the programmed output pulse repetition frequency.

In yet another aspect, an exemplary embodiment of the present invention relates to a system for controlling one or more servos coupled to a model vehicle. The system includes a model vehicle, a transmitter, and a receiver. The model vehicle has one or more servos coupled thereto. The transmitter is configured to transmit a signal encoded with a series of control input pulses at an average input frame frequency. The receiver is mounted on the model vehicle and is configured to output a servo control pulse as a function of at least one of the control input pulses to at least one of the servos at an output pulse repetition frequency, wherein the receiver is further configured to receive the signal.

BRIEF DESCRIPTION OF THE SEVERAL VIEWS OF THE DRAWINGS

Illustrative embodiments of the present invention are described in detail below with reference to the attached drawing figures, which are incorporated by reference herein and wherein.

DETAILED DESCRIPTION

Figure 1:
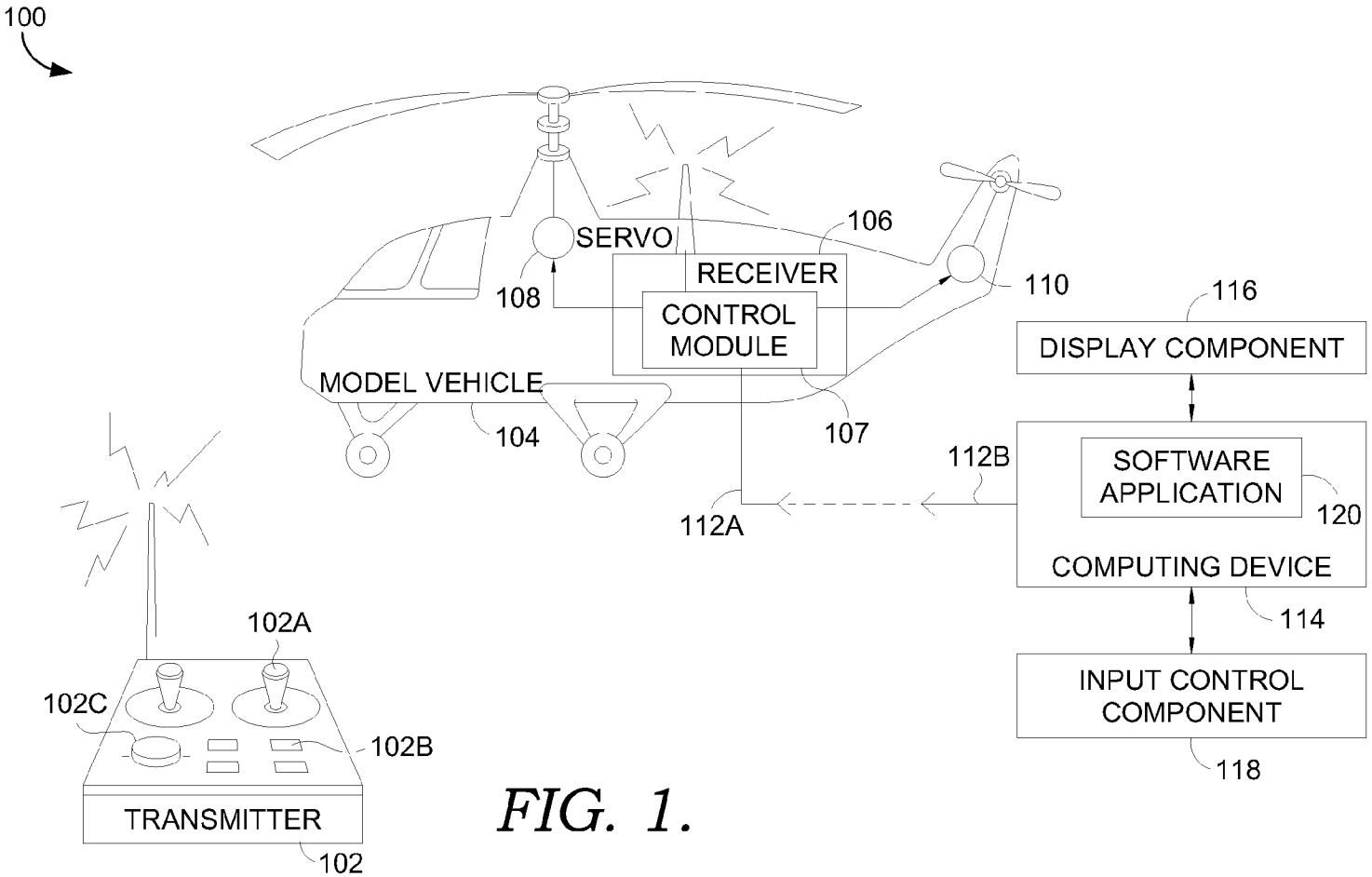
FIG. 1 depicts an exemplary system environment suitable for use in implementing embodiments of the present invention.

Embodiments of the present invention provide systems and methods for generating servo control pulses at a programmable pulse repetition frequency that is different from an average input frame frequency.

While the type of vehicle described in detail herein is a model vehicle, one skilled in the art will appreciate that the present invention may be implemented with other types of remotely controllable vehicles. Likewise, one skilled in the art will appreciate that while a general purpose computer (e.g., personal computer) is described herein as an example for programming an output pulse repetition frequency, the present invention may be implemented with other types of computing devices.

Throughout the description of the present invention, several acronyms and shorthand notations are used to aid the understanding of certain concepts pertaining to the associated system and services. These acronyms and shorthand notations are solely intended for the purpose of providing an easy methodology of communicating the ideas expressed herein and are in no way meant to limit the scope of the present invention. The following is a list of these acronyms:

| | |
|---|---|
| ADC | Analog-to-Digital Converter |
| AM | Amplitude Modulation |
| API | Application Programming Interface |
| CD-ROM | Compact Disc-Read Only Memory |
| DVD | Digital Versatile Disc |
| EEPROM | Electrically Erasable Programmable Read Only Memory |
| FM | Frequency Modulation |
| FSK | Frequency-Shift Keying Modulation |
| Hz | Hertz (unit of frequency - per second) |
| IEEE | Institute of Electrical and Electronics Engineers |
| IP | Internet Protocol |
| PDA | Personal Digital Assistant |
| PM | Phase Modulation |
| PPM | Pulse Period Modulation |
| PSK | Phase-Shift Keying Modulation |
| PCM | Pulse Code Modulation |
| RAM | Random Access Memory |
| ROM | Read Only Memory |
| TCP | Transmission Control Protocol |
| USB | Universal Serial Bus |

As one skilled in the art will appreciate, embodiments of the present invention may be embodied as, among other things: a method, system, or computer-readable medium. Accordingly, the embodiments may take the form of a hardware embodiment, a software embodiment, or an embodiment combining software and hardware. In one embodiment, the present invention takes the form of one or more computer-readable media that include computer-useable instructions embodied thereon.

Computer-readable media include both volatile and non-volatile media, removable and nonremovable media, and also include media readable by a database, a computer, and various other computing devices. By way of example, and not limitation, computer-readable media comprise computer-storage media and communications media.

Computer-storage media, or machine-readable media, include media implemented in any method or technology for storing information. Examples of stored information include computer-useable instructions, data structures, program modules, and other data representations. Computer-storage media include, but are not limited to RAM, ROM, EEPROM, flash memory or other memory technology, CD-ROM, digital versatile discs (DVD), holographic media or other optical disc storage, magnetic cassettes, magnetic tape, magnetic disk storage, and other magnetic storage devices. These memory components can store data momentarily, temporarily, or permanently.

Communications media typically store computer-useable instructions—including data structures and program modules—in a modulated data signal. The term "modulated data signal" refers to a propagated signal that has one or more of its characteristics set or changed to encode information in the signal. An exemplary modulated data signal includes a carrier wave or other transport mechanism. Communications media include any information-delivery media. By way of example but not limitation, communications media include wired media, such as a wired network or direct-wired connection, and wireless media such as acoustic, infrared, radio, microwave, spread-spectrum, and other wireless media technologies. Combinations of the above are included within the scope of computer-readable media.

The subject matter of the present invention is described with specificity herein to meet statutory requirements. However, the description itself is not intended to limit the scope of this patent. Rather, the inventors have contemplated that the claimed subject matter might also be embodied in other ways, to include steps or combinations of steps similar to the ones described in this document, in conjunction with other present or future technologies. Moreover, although the terms "step" and/or "block" may be used herein to connote different elements of methods employed, the terms should not be interpreted as implying any particular order among or between various steps herein disclosed.

Turning now to FIG. 1, an exemplary system environment suitable for use in implementing embodiments of the present invention is provided and referenced generally by the numeral 100. As with all of the figures herein, FIG. 1 is illustrative in nature and should not be construed as limiting the present invention. It should be understood that this and other arrangements described herein are set forth only as examples. Other arrangements and elements (e.g., machines, interfaces, functions, orders, and groupings of functions, etc.) can be used in addition to or instead of those shown, and some elements may be omitted altogether. Further, many of the elements described herein are functional entities that may be implemented with other components and in any suitable combination and location. Various functions described herein as being performed by one or more entities may be carried out by hardware, firmware, and/or software. For instance, some functions may be carried out by a processor executing instructions stored in memory.

As shown in FIG. 1, system environment 100 may include, among other components, a transmitter 102, a set of control components on the transmitter 102A, 102B, 102C, a model vehicle 104, a receiver 106, a control module 107, a set of servos 108, 110, communication ports 112A, 112B, a computing device 114, a display component 116, an input control component 118, and software application 120.

The transmitter 102 may be any of a wide variety of digital or analog transmitters, and more specifically radio control transmitters, that are known in the art. For example, the transmitter 102 may be a simple, inexpensive transmitter, or it may be a more sophisticated transmitter having multiple vehicle memories. The transmitter 102 typically has a power source that provides power for transmission of signals. The transmitter 102 may also support a varying number of channels for transmitting control input pulses.

The transmitter 102 typically has a set of control elements comprising one or more of a control stick 102A, a trigger, a switch 102B, and a dial knob 102C. In general, the transmitter 102 generates control input pulses based on the control elements 102A, 102B, 102C, modulates the control input pulses, and transmits a signal encoded with the control input pulses to the receiver 106. The transmitter 102 may use any of the modulation techniques known in the art. Typically, however, either pulse code modulation (PCM) or pulse period modulation (PPM) is employed for radio controlled model vehicles.

The model vehicle 104 may be any model vehicle having the receiver 106 and the servos 108, 110. Although remote controlled model vehicles are used to illustrate an exemplary system environment and methods, the model vehicle 104 may be any vehicle that is equipped to receive control input pulse and operates in accordance with the control input pulses. The model vehicle 104 may be a car, a truck, a helicopter, a sailboat, a motor boat, a ship, an airplane, a robot, a submarine, etc.

The receiver 106 may be any of a wide variety of digital or analog receivers and more specifically radio control receivers, that are known in the art. The receiver 106 is typically mounted on the model vehicle 104. In general, the receiver 106 receives a signal encoded with control input pulses from the transmitter 102, demodulates the signal to recover the control input pulses, maps the control input pulses to a vehicle-specific set of servo control pulses, and communicates the vehicle-specific servo control pulses to the servos 108, 110. The receiver 106 may use any of the demodulation techniques known in the art.

The receiver 106 may include the communication port 112A that can be used to connect to the computing device 114. The receiver 106 may also have a set of servo control signal output ports connected to the servos 108, 110. The receiver 106 may also include the control module 107. In general, the control module 107 is communicatively coupled to the receiver. Alternatively, the control module 107 may be integrated with the receiver 107.

In one embodiment, the control module 107 receives control inputs from the receiver 106 and maps the control inputs to a set of servo control signals. The control module 107 may output the servo control signals directly to the servos 108, 110. It may also pass the servo control signals to the receiver 106 for transmission thereof to the servos 108, 110. In some embodiments the control module 107 may have a communication port, such as the communication port 112A, to communicate with the computing device 114. In some other embodiments, the receiver 106 may have the communication port 112*a* and the control module 107 may communicate with the computing device 114 through the communication port 112A on the receiver 106. The control module 107 may also send the control inputs to the computing device 114 through the communication port 112A.

The control module 107 may comprise a special circuitry running a specially designed firmware. It may comprise a general signal processing circuitry running a proprietary software module. It may also comprise a software module designed to perform a set of complex mathematical operations on data passed from the receiver 106.

Typically, the servos 108, 110 are electric motors that use electrical energy to create mechanical force. In general, the servos 108, 110 provide angular output although linear output is not uncommon. For example, the servos 108, 110 may be connected to a reduction gearbox to drive various mechanical parts. The servos 108, 110 are driven until a position and/or speed commanded by one or more servo control pulses generated at the receiver 106 or the control module 107 are attained. Even though only two servos (i.e., the servos 108, 110) are shown in FIG. 1, any number of servos may be coupled to the model vehicle 104. For example, a sophisticated model vehicle may have many tens of servos, and a less sophisticated model vehicle may only have one or two servos.

Applications for the servos 108, 110 abound. By way of example and not limitation, the servos 108, 110 may be used to control main rotor, cyclic controls (pitch and roll), and tail rotor (yaw) of model helicopters. The servos 108, 110 may be used to control ailerons, elevators, main propeller, rudder, landing gears, and flaps of model airplanes. The servos 108, 110 may be used to control motor speed and steering gear or rudder of a land vehicle or a boat, respectively.

Typically, the communication ports 112A, 112B are universal serial bus (USB) ports. However, they may also be serial ports, parallel ports, IEEE 1394 ports, and the like. In general, the communication ports 112A, 112B are located on the receiver 106 and the computing device 114, respectively. Alternatively, however, the communication port 112A may be located on the control module 107.

Typically, the computing device 114 is a general purpose computer (e.g., personal computer) running a common operating system (e.g., Microsoft® Windows®, Mac OS®, or a Linux® operating system) that provides a graphical user interface and a network interface (e.g., TCP/IP interface) for communication through a network (e.g., the Internet). The computing device 114 may run the software application 120, through which a user can program an output pulse repetition frequency at the receiver 106 or the control module 107. In general, no distinction is made herein between such categories as "workstation," "server," or "laptop."

The computing device 114 may be, however, other types of computing devices that can communicate with the receiver 106 or the control module 107. Such other types of computing devices may be a PDA, a Smart-Phone, a Blackberry®, a mobile phone and any other device that may include a bus that directly or indirectly couples memory, one or more processors, input/output ports, input/output components, and a power supply.

The computing device 114 may also support peripheral devices, such as the display component 116 and the input control component 118 and a communication port such as the communication port 112B. The display component 116 and the input control component 118 may be communicatively coupled to the computing device 114. For instance, the display component 116 may be a computer monitor or any other display device. The input control component 118 may be a keyboard, a mouse, or any other input devices. The connection between the input control component 116 and the computing device 114 may be wireless, such as an infrared, or directly by a cable or other physical connection such as a USB connector. Alternatively, the display component 116 and the input control component 118 may be integrated with the computing device 114 as in a laptop computer.

In general, the software application 120 is a proprietary software program that establishes communication with the receiver 106 or the control module 107 through the communication ports 112A, 112B and provides users a user-interface for programming the receiver 106 or the control module 107. For example, a dialog window can be provided for users to program an output pulse repetition frequency.

The software application 120 may also take the form of a class or function library (e.g., a dynamic link library, a Java package) or a set of application programming interfaces (APIs) (e.g., Unix system call library). Users can build a small program module or a script that links to the function library and invokes the functions provided by such library to program the receiver 106.

Figure 2:
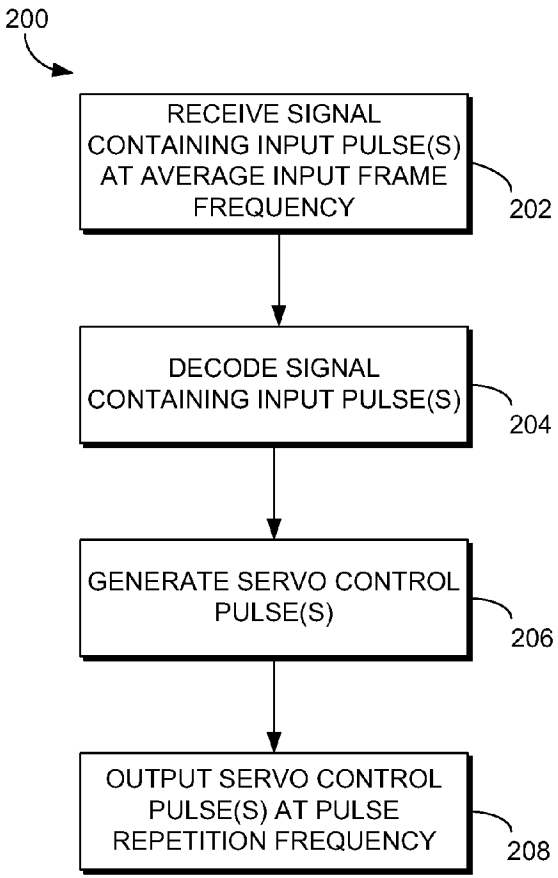
FIG. 2 is a flow diagram showing an exemplary method for outputting servo control pulses at a programmable output pulse repetition frequency that is different from an average input frame frequency in accordance with an embodiment of the present invention.

Turning to FIG. 2, a flow diagram is used to show an exemplary method 200 for outputting servo control pulses at a programmable output pulse repetition frequency that is different from an average input frame frequency in accordance with an embodiment of the present invention. At block 202, the receiver 106 receives from the transmitter 102 a signal having a series of input pulses encoded at an average input frame frequency. In some embodiments, for example, the transmitter 102 transmits the input pulses at a repetition frequency of 50 Hz. Typically, the input pulses reflect at least one of the control elements 102A, 102B, 102C on the transmitter 102.

In general, the transmitter 102 may encode the input pulses using a wide variety of the digital and analog modulation techniques that are known in the art, such as amplitude modulation (AM), frequency modulation (FM), phase modulation (PM), phase-shift keying modulation (PSK), frequency-shift keying modulation (FSK), pulse width modulation (PWM), pulse period modulation (PPM), pulse code modulation (PCM), spread spectrum, etc. Typically, however, either pulse code modulation (PCM) or pulse period modulation (PPM) is employed for the model vehicles 104.

At block 204, the signal is decoded to recover the input pulses encoded therein. In some embodiments, a timer is used to time the input pulses as the pulses come in. In some embodiments, the receiver 106 also caches the recovered input pulses. In such embodiments, the receiver 106 typically caches the input pulses in a buffer memory or a cache memory. The input pulses are cached, for example, to be mapped to servo control pulses. For instance, one or more servo control pulses may be functions of one or more of the input pulses.

At block 206, one or more servo control pulses are generated using at least one of the input pulses. For example, the servo control pulses may be functions of the input pulses. In some embodiments, the receiver 106 uses the input pulses to generate the servo control pulses by mapping the input pulses to the servo control pulses in accordance with a preprogrammed setting saved therein. For instance, the receiver 106 may map the same input pulse to more than one output servo control pulse.

At block 208, the receiver 106 outputs each of the servo control pulses generated at block 206 to at least one of the servos 108, 110 at an output pulse repetition frequency. In some embodiments, the output pulse repetition frequency can be adjusted. In some other embodiments, the output pulse repetition frequency is predetermined and cannot be adjusted subsequently. For example, the output pulse repetition frequency of some receivers may be set at a receiver manufacturing factory for maximum performance of a particular type of servos that are specially designed to work with those receivers.

In some embodiments, the receiver 106 generates additional servo control pulses if the output pulse repetition frequency is higher than the average input frame frequency. In some embodiments, the receiver 106 discards some of the received input pulses if the output pulse repetition frequency is lower than the average input frame frequency. For example, if an input pulse is received at the average input frame frequency of 50 Hz and the receiver 106 generates and outputs a servo control pulse at an output pulse repetition frequency of 100 Hz, the receiver 106 would have to generate 50 additional servo control pulses per second, whereas if the average input frame frequency of 50 Hz and an output pulse repetition frequency of 10 Hz are used, the receiver 106 would have to discard 40 servo control pulses per second.

Figure 3:
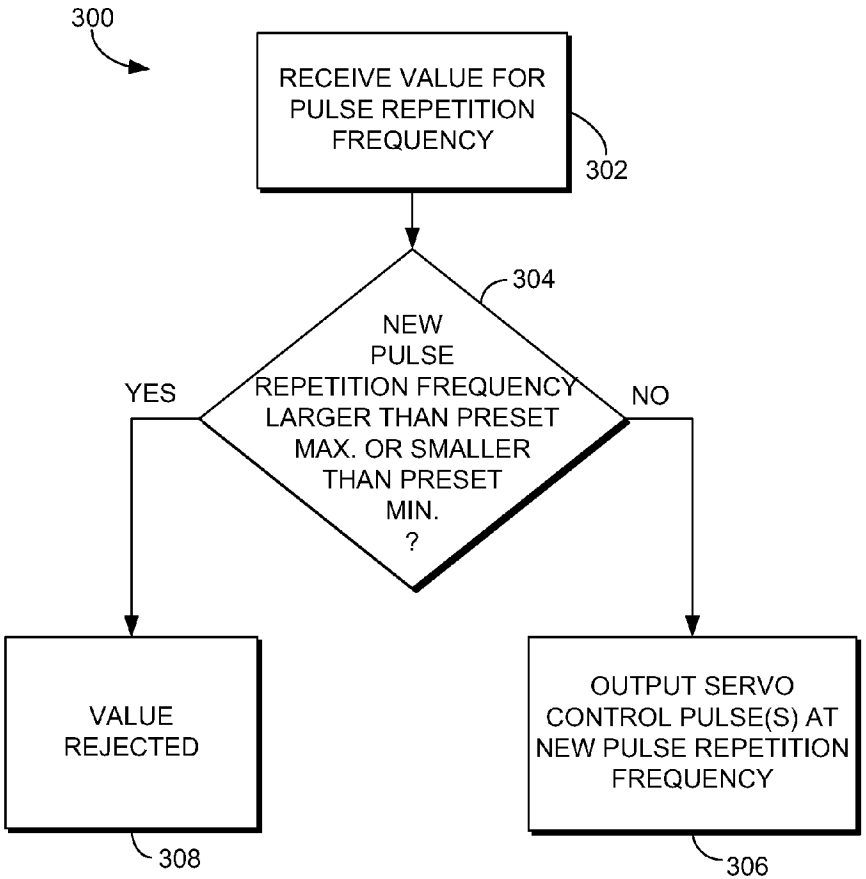
FIG. 3 is a flow diagram showing an exemplary method for adjusting an output pulse repetition frequency in accordance with an embodiment of the present invention.

Turning to FIG. 3, a flow diagram is used to show an exemplary method 300 for adjusting an output pulse repetition frequency in accordance with an embodiment of the present invention. At block 302, the receiver 106 receives a value for an output pulse repetition frequency. In general, the received value is used to adjust the current output pulse repetition frequency by adding or subtracting the received value thereto/from. In some embodiments, however, the received value may replace the current output pulse repetition frequency.

In some embodiments, the output pulse repetition frequency may be adjusted from an interface element on the receiver 106 while the receiver 106 is tested at rest. For example, an increase (+) or decrease (−) button on the receiver of the model airplane may be used to adjust the output pulse repetition frequency thereof. In some embodiments, the output pulse repetition frequency may be adjusted from the computing device 114 while the receiver 106 is fully engaged in normal operations.

For example, a user flying a model airplane in a field realizes that the output pulse repetition frequency of the model airplane, which was programmed into the model airplane receiver the night before, need to be readjusted. The transmitter that he uses, however, malfunctions, preventing him from adjust the output pulse repetition frequency. Luckily, the user quickly realizes that he downloaded and installed a software, such as the software application 120, on his mobile phone. The user adjusts the output pulse repetition frequency using the mobile phone by communicating an adjustment value to the receiver 106.

At block 304, it is determined whether the received value (e.g., replacement value) or the adjusted output pulse repetition frequency resulting from the received value (e.g., adjustment value) exceeds a preset maximum or falls below a preset minimum. Typically, the maximum is set to avoid poor performance or possible damages to the servos 108, 110 from operating beyond their capacity. If the replacement or adjustment value exceeds the preset maximum or falls below the preset minimum, it is rejected at block 308. In some embodiments, a user is given an indication that the replacement or adjustment value exceeds the preset maximum.

If, on the other hand, the replacement or adjustment value is equivalent to or less than the preset maximum, the receiver 106 begins outputting servo control pulses at the replaced or adjusted (new) output pulse repetition frequency at block 306. In some embodiments, a counter is used to implement the output pulse repetition frequency. For example, the counter counts down for a time period that corresponds to the output pulse repetition frequency and signals the receiver 106 to output a servo control pulse when the count reaches zero. Then the counter repeats the counting process again. In some embodiments, a separate counter is employed in the receiver 106 for each output servo control pulse. In such embodiments, different repetition frequency can be programmed for each servo control pulse. In some other embodiments, a single master counter is employed in the receiver 106 for all of the output servo control pulses. In yet some other embodiments, a frame of input pulses is stored in a memory location in the receiver 106 in the smallest increment of time controllable for the output servo control pulses. In such embodiments, an update process running in the receiver 106 updates the input pulses saved in the memory location each time a frame of input pulses containing at least one new input pulse is received.

Figure 4:
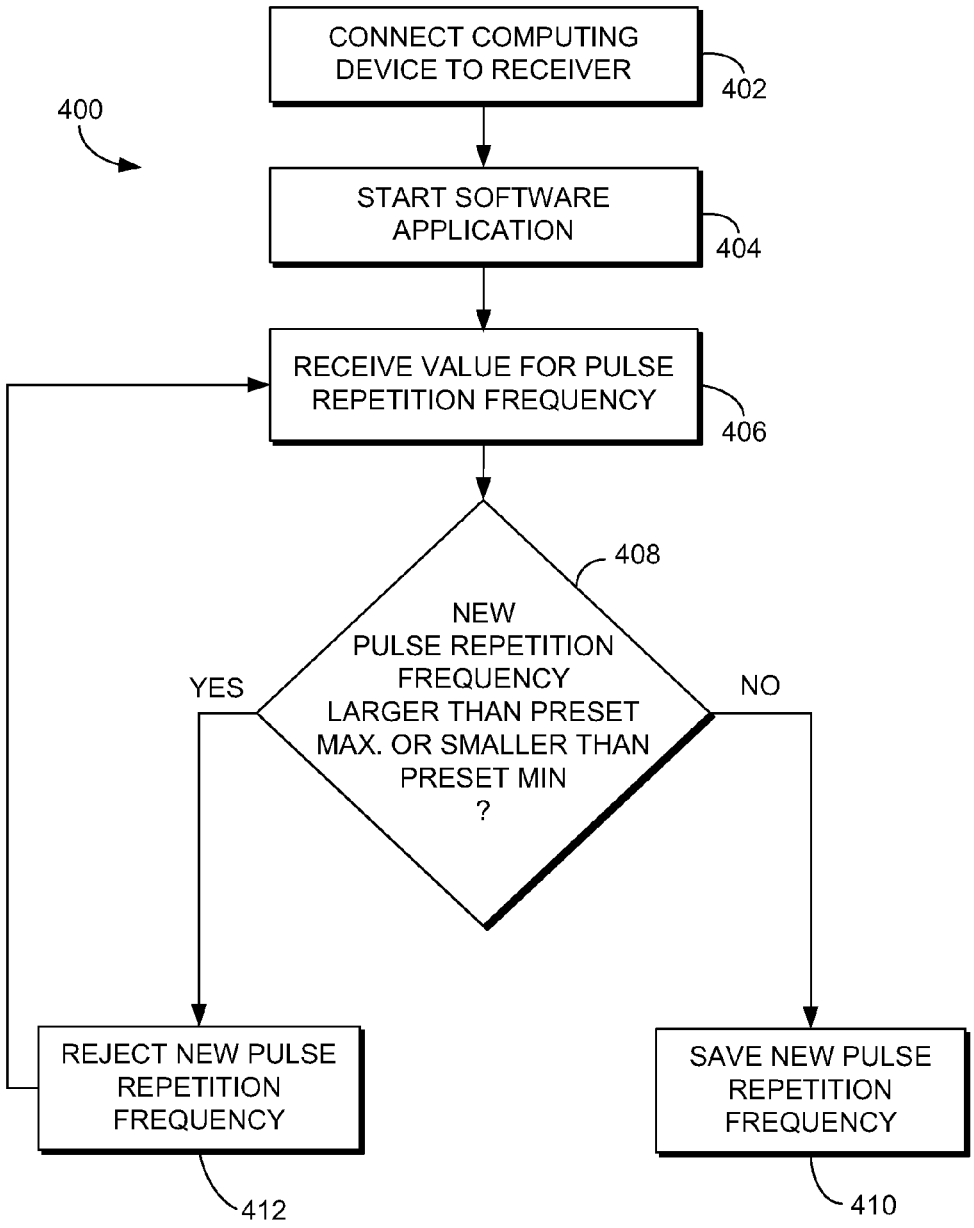
FIG. 4 is a flow diagram showing an exemplary method for programming an output pulse repetition frequency in accordance with an embodiment of the present invention.

Turning to FIG. 4, a flow diagram is used to show an exemplary method 400 for programming an output pulse repetition frequency in accordance with an embodiment of the present invention. At block 402, the computing device 114 is connected to the receiver 106. In general, the computing device 114 may be physically connected through the communication ports 112A, 112B. In some embodiments, however, the computing device 114, such as a wireless mobile device, can wirelessly communicate with the receiver 106. At block 404, the software application 120 is started.

At block 406, an adjustment or a replacement value (a new value) for the output pulse repetition frequency is received. In some embodiments, the receiver 106 is configured to output each of servo control pulses at the same output pulse repetition frequency. In some other embodiments, the receiver 106 is configured to output each of the servo output pulses at a different output pulse repetition frequency. In such embodiments, new values for a set of output pulse repetition frequencies are received.

At block 408, each replaced output pulse repetition frequency or adjusted output pulse repetition frequency (new output pulse repetition frequency) resulting from an adjustment value received at block 406 or is examined to determine whether the new output pulse repetition frequency exceeds a preset maximum or falls below a preset minimum. If it is determined that the new output pulse repetition frequency exceeds the preset maximum or falls below a preset minimum, the new output pulse repetition frequency is rejected at block 412 and a user is prompted to enter a different adjustment or replacement value again at block 406. In some embodiments, an error message is displayed for the user.

If, on the other hand, it is determined that the new output pulse repetition frequency is equivalent to or lower than the preset maximum and equivalent to or larger than the preset minimum, the new repetition frequency is saved at block 410. In the embodiments in which the receiver 106 is configured to output different servo control pulses at different output pulse repetition frequencies, all of output pulse repetition frequencies can be reprogrammed or only some of the output pulse repetition frequencies may be reprogrammed.

Figure 5:
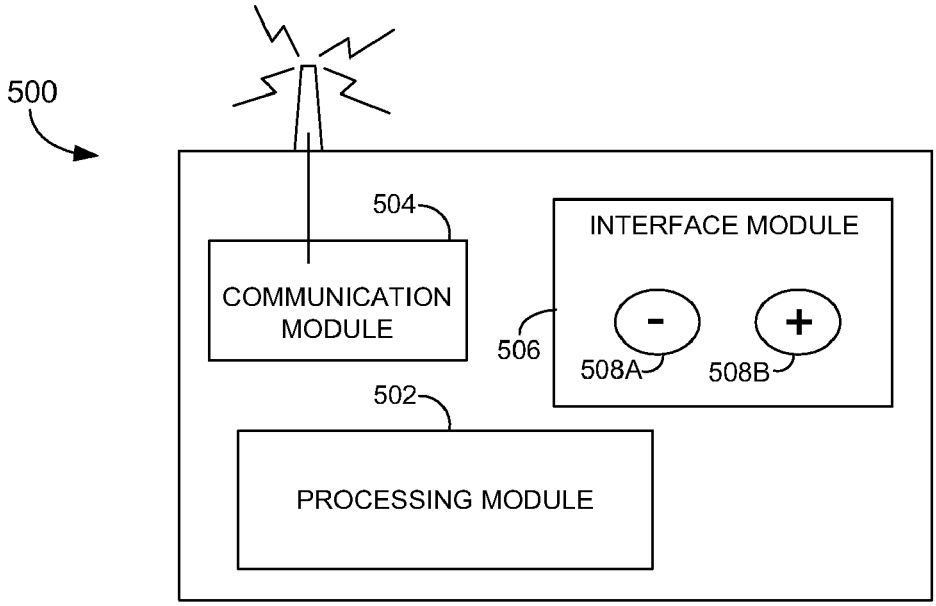
FIG. 5 is a block diagram showing an exemplary system for controlling one or more servos coupled in a model vehicle in accordance with an embodiment of the present invention.

Turning to FIG. 5, a block diagram is used to show an exemplary receiver 500 for controlling one or more servos coupled in a model vehicle in accordance with an embodiment of the present invention. The receiver 500 includes a processing module 502, a communication module 504, and an interface module 506, which has a set of interface elements 508A, 508B. The communication module 504 is configured to receive an input signal having a series of input pulses encoded at an input pulse repetition frequency from the transmitter 102. In some embodiments, the communication module 504 is also configured to decode the input signal to recover the input pulses.

The processing module 502 is configured to generate a servo control pulse using at least one of the input pulses and to output the servo control pulse to at least one of the servos 108, 110 at an output pulse repetition frequency. For example, the servo control pulse may be a function of the input pulses. In some embodiments, the processing module 502 can generate more than one servo control pulse using one or more of the input pulses at varying output pulse repetition frequencies. For example, the processing module 502 can generate two servo control pulses using the input pulses at different output pulse repetition frequencies.

In some embodiments, the processing module 502 is also configured to cache the input pulses. In some other embodiments, the communication module 504 is configured to cache the input pulses. The input pulses are cached, for example, to be mapped to servo control pulses. For instance, a servo control pulse may be a function of one or more of the input pulses. In some embodiments, the processing module 502 includes the communication port 112A. In such embodiments, the computing device 114 can connect to the processing module 502 through the communication port 112B to program one or more output pulse repetition frequencies. In some embodiments, the processing module 502 can also communicate with a wireless mobile device to receive one or more adjustment or replacement values for one or more output pulse repetition frequencies.

The interface module 506 is configured to receive an adjustment or a replacement value (a new value) for one or more second repetition frequencies. Typically, the new value is received manually through the interface elements 508A, 508B, such as in an increase (+) or decrease (−) button, a dial knob, a sidebar, a keypad, and the like. In some embodiments, the interface module 506 generates one or more new values in response to an activation of the interface elements 508A, 508B and communicates the new values to the processing module 502. The processing module 502 uses the new values to adjust or replace one or more output pulse repetition frequencies.

Figure 6:
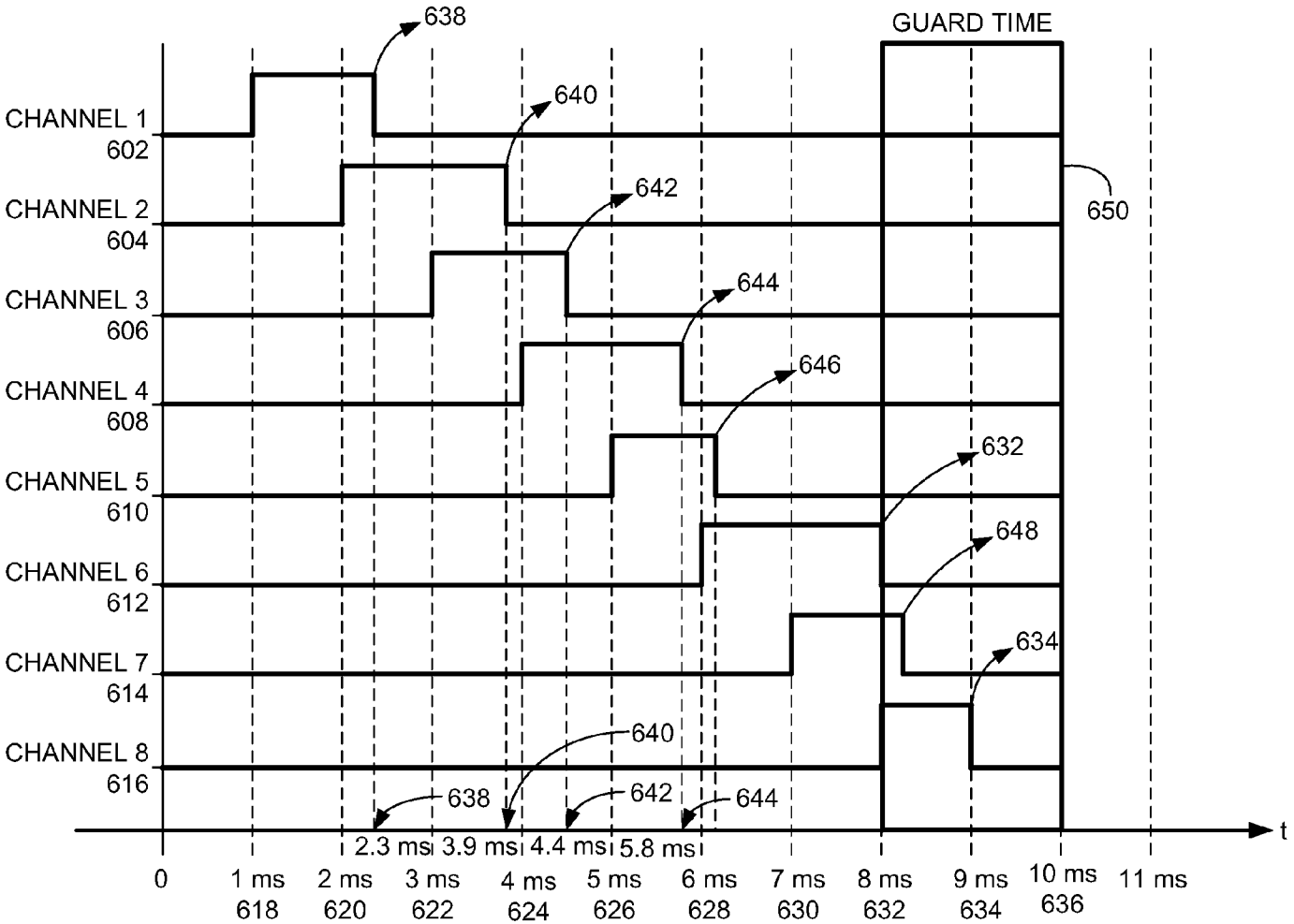
FIG. 6 is a diagram showing an exemplary set of servo control pulses generated at a programmable pulse repetition frequency using a programmable counter in accordance with an embodiment of the present invention.

Turning to FIG. 6, a diagram shows an exemplary set of servo control pulses 600 generated at a programmable pulse repetition frequency using a number of programmable counters in accordance with an embodiment of the present invention. A plurality of output servo control pulses 602, 604, 606, 608, 610, 612, 614, and 616 are generated at an eight channel receiver with pulse widths of 1.3 milliseconds (ms), 1.9 ms, 1.4 ms, 1.8 ms, 1.1 ms, 2.0 ms, 1.2 ms, and 1.0 ms, respectively. The pulse widths of the output servo control pulses typically vary between a maximum value and a minimum value. In a particular embodiment, the maximum pulse width is 2 ms and the minimum pulse width is 1 ms. The receiver is programmed to output servo control pulses at a pulse repetition frequency of 111 Hz, resulting in a pulse repetition period of about 9 ms for eight output servo control pulses. Another embodiment uses a maximum pulse width of 2.2 ms and a minimum pulse width of 0.8 ms.

The receiver is programmed to output each of the eight servo control pulses beginning on adjacent 1 ms intervals. At 618, the guard time from the prior frame expires and so a microprocessor in the receiver is interrupted to output the first of the eight servo control pulses 602. An interrupt handler then toggles channel 1 from low to high, reads the first servo control pulse width of 1.3 ms, and set a first timer to expire after 1.3 ms.

At 620, the microprocessor is interrupted to output the second servo control pulse 604. The interrupt handler then toggles channel 2 from low to high, reads the second servo control pulse width of 1.9 ms, and sets a second timer to expire after 1.9 ms. At 638, the microprocessor is interrupted again to toggle channel 1 back to low when the first timer expires.

At 622, the microprocessor is interrupted to output the third servo control pulse 606. The interrupt handler then toggles channel 3 from low to high, reads the third servo control pulse width of 1.4 ms, and sets a third timer to expire after 1.9 ms. At 640, the microprocessor is interrupted again to toggle channel 2 back to low when the second timer expires.

The remaining servo control pulses are outputted using similar processes within the output pulse repetition period of 9 ms. In the present embodiment, no more than two pulses are being generated at a given time, the first three timers may therefore be re-used. A guard time 650 is used to separate each repetition period to avoid pulse overlapping between two adjacent periods. Typically, the guard time is set to be equivalent to the maximum pulse width. At the conclusion of the guard time shown, one frame that began with 618 is complete, and so the cycle repeats in subsequent frames. In some embodiments, the rise times for adjacent channels are evenly spaced. For example: an input frequency of F Hz, a guard time of G seconds, and N output channels may be used with evenly spaced rise times separated by R seconds. The rise time separation is then given by the equation:

$$R=(1/F-G)/(N-1).$$

Again with regard to FIG. 6, another embodiment of the present invention makes use of a single timer. As those skilled in the art will appreciate, a single byte of information may be used to define the state of all ports at a given time. For example, if Channel 8 is the most significant bit of the upper nibble, channel 5 is the least significant bit of the upper nibble, channel 4 is the most significant bit of the lower nibble, and channel 1 is the least significant bit of the lower nibble, then the output value may be controlled with a single timer as follows. Prior to the start of the output pulse repetition control period (before 618), the control byte output is 00 hexadecimal. A preprocessing algorithm defines how the state of the control byte is determined at each point within the pulse repetition control period. An interrupt service routine then is called to determine the next port values and to assign them, and to set a timer to expire at the correct time. At 618 the interrupt service routine determines that the control byte should be 01 hexadecimal. This value is then assigned, and the timer is set to expire in 1 ms. At 620 the interrupt service routine is called again and determines that the control byte should be 03 hexadecimal. This value is then assigned and the timer is set to expire in 0.3 ms. This type of processing is repeated until the output pulse repetition control period completes at 636, which is 9 ms from the beginning of the control period. The processing period is then repeated, implementing a common output pulse repetition frequency for all channels.

As can be seen, the present invention and its equivalents are well-adapted to provide a new and useful method for generating servo control pulses for a model vehicle at a programmable output pulse repetition frequency that is different from an average input frame frequency.

Many different arrangements of the various components depicted, as well as components not shown, are possible without departing from the spirit and scope of the present invention. Embodiments of the present invention have been described with the intent to be illustrative rather than restrictive. Alternative embodiments will become apparent to those skilled in the art that do not depart from its scope. A skilled artisan may develop alternative means of implementing the aforementioned improvements without departing from the scope of the present invention.

It will be understood that certain features and subcombinations are of utility and may be employed without reference to other features and subcombinations and are contemplated within the scope of the claims. Not all steps listed in the various figures need be carried out, or carried out at all in some instances, in the specific order described.

The invention claimed is:

1. One or more non-transitory computer-readable media having computer-useable instructions embodied thereon to perform a method for controlling one or more servos coupled to a model vehicle said method comprising:

receiving, at a receiver coupled to a model vehicle having one or more servos, an input signal having a series of input pulses encoded at an average frame frequency;

decoding the input signal at the receiver;

generating a servo control pulse at the receiver using at least one of the input pulses; and outputting the servo control pulse to at least one of the servos at a first pulse repetition frequency that is different from the average frame frequency.

2. The computer-readable media of claim 1, said method further comprising:

generating a second servo control pulse at the receiver using at least one of the input pulses; and outputting the second servo control pulse to at least one of the servos at the first pulse repetition frequency.

3. The computer-readable media of claim 1, said method further comprising caching the decoded input pulses at the receiver.

4. The computer-readable media of claim 2, said method further comprising:

receiving, at the receiver, a second pulse repetition frequency from a computing device;

and outputting the second servo control pulse to the at least one of the servos at the second pulse repetition frequency.

5. The computer-readable media of claim 1, wherein the servos govern actuation of control elements comprising one or more of a wheel, a propeller, a flap, an elevator, a landing gear, a robotic arm, a rudder, an aileron, a steering gear, a spoiler, a throttle, a rotor, and a sail.

6. The computer-readable media of claim 1, wherein the first pulse repetition frequency is programmed from a computing device communicatively connected to the receiver.

7. The computer-readable media of claim 1, wherein the first pulse repetition frequency is adjusted from one or more interface elements on the receiver.

8. The computer-readable media of claim 1, wherein at least one limitation is placed on the first repetition frequency, said limitation drawn from the set consisting of a first preset value that limits the maximum and a second preset value that limits the minimum.

9. The computer readable media of claim 1, wherein said outputting is controlled using at least one programmable counter.

10. A receiver for generating servo control pulses for a model vehicle having one or more servos at a programmable output pulse repetition frequency that is different from an input average frame frequency, the receiver comprising:

a communication module configured to receive an input signal having a series of input pulses encoded at an average frame repetition frequency; and a processing module configured to output a servo control pulse generated using at least one of the input pulses to at least one of the servos at an output pulse repetition frequency that is different from the average frame repetition frequency.

11. The receiver of claim 10, wherein the processing module is further configured to output a second servo control pulse generated using at least one of the input pulses to at least one of the servos at the output pulse repetition frequency.

12. The receiver of claim 10, wherein the processing module is further configured to receive an adjustment value for the output pulse repetition frequency from a computing device and to output the servo control pulse to the at least one of the servos at a new output pulse repetition frequency generated using the adjustment value.

13. The receiver of claim 10, wherein the processing module is further configured to receive a new output pulse repetition frequency from a computing device and to output the servo control pulse to the at least one of the servos at the new output pulse repetition frequency.

14. The receiver of claim 10, further comprising an interface module having one or more interface elements configured to receive an adjustment value for the output pulse repetition frequency through the interface elements.

15. A system for controlling a model vehicle having one or more servos at a programmable output pulse repetition frequency that is different from an input average frame frequency, the system comprising:

a model vehicle having one or more servos coupled thereto;

a transmitter configured to transmit a signal encoded with a series of control input pulses at an input average frame frequency; and a receiver mounted on the model vehicle and configured to receive the signal from the transmitter and to output a servo control pulse as a function of at least one of the control input pulses to at least one of the servos at an output pulse repetition frequency that is different from the input average frame frequency.

16. The system of claim 15, further comprising a computing device communicatively connected to the receiver and configured for programming the receiver.

17. The system of claim 16, wherein programming the receiver comprises adjusting the output pulse repetition frequency.

18. The system of claim 15, wherein the receiver is further configured to receive a new output pulse repetition frequency from a computing device and to output the servo control pulse to the at least one of the servos at the new output pulse repetition frequency.

19. The system of claim 15, wherein the receiver is further configured to receive an adjustment value for the output pulse repetition frequency from a computing device, to adjust the output pulse repetition frequency using the adjustment value, and to output the servo control pulse to the at least one of the servos at the adjusted output pulse repetition frequency.

20. The system of claim 15, wherein the receiver is further configured to cache the control input pulses.

* * * * *